US011179771B2

(12) United States Patent
Su et al.

(10) Patent No.: US 11,179,771 B2
(45) Date of Patent: Nov. 23, 2021

(54) EQUIPMENT AND METHOD OF SEMI-CONTINUOUS CASTING OPTIMIZED BY SYNERGISTIC ACTION OF TRAVELING MAGNETIC FIELD AND ULTRASOUND WAVE FOR THIN-WALLED ALLOY CASTING WITH EQUAL OUTER DIAMETER

(71) Applicant: Harbin Institute of Technology, Harbin (CN)

(72) Inventors: Yanqing Su, Harbin (CN); Lei Luo, Harbin (CN); Liangshun Luo, Harbin (CN); Liang Wang, Harbin (CN); Ruirun Chen, Harbin (CN); Jingjie Guo, Harbin (CN); Jingsong Hou, Harbin (CN); Qingfeng Yuan, Harbin (CN); Chunhui Li, Harbin (CN)

(73) Assignee: Harbin Institute of Technology, Harbin (CN)

( * ) Notice: Subject to any disclaimer, the term of this patent is extended or adjusted under 35 U.S.C. 154(b) by 0 days.

(21) Appl. No.: 17/026,265

(22) Filed: Sep. 20, 2020

(65) Prior Publication Data

US 2021/0086257 A1 Mar. 25, 2021

(30) Foreign Application Priority Data

Sep. 20, 2019 (CN) ..... 201910893914.8

(51) Int. Cl.
*B22D 11/114* (2006.01)
*B22D 11/16* (2006.01)
(Continued)

(52) U.S. Cl.
CPC ..... *B22D 11/115* (2013.01); *B22D 11/049* (2013.01); *B22D 11/114* (2013.01); *B22D 11/16* (2013.01); *B22D 11/186* (2013.01)

(58) Field of Classification Search
CPC ... B22D 11/006; B22D 11/049; B22D 11/114; B22D 11/115; B22D 11/16; B22D 11/186; B22D 11/205
See application file for complete search history.

(56) References Cited

U.S. PATENT DOCUMENTS 3,486,550 A * 12/1969 Yearley ..... B22D 11/0401 164/416
4,498,518 A * 2/1985 Hasebe ..... B22D 11/053 164/416
6,253,831 B1 * 7/2001 Genma ..... C22C 47/08 164/499

FOREIGN PATENT DOCUMENTS

EP 0857529 A1 * 8/1998 ..... B22D 11/006

* cited by examiner

*Primary Examiner* — Kevin E Yoon
(74) *Attorney, Agent, or Firm* — Novoclaims Patent Services LLC; Mei Lin Wong

(57) ABSTRACT

A semi-continuous casting equipment for thin-walled alloy castings with equal outer diameter, optimized by synergistic action of traveling magnetic fields and ultrasonic wave, includes: a melting and insulation device, a heat insulation panel, a traveling magnetic field generator and a water-cooled crystallizer sequentially positioned on a working platform; an outer mold positioned on the water-cooled crystallizer and sleeved the traveling magnetic field generator; a mold core inside the outer mold defining a casting cavity; a bottom plate below the mold core capable of sliding against and along an inner side of the outer mold; two position control units supported by the working platform; an ultrasonic limit baffle moveably engaged with the position control units; an ultrasonic wave generator affixed on the ultrasonic limit baffle and extended to the casting cavity; a
(Continued)

motion system controlling up and down movement of the bottom plate and the position control units through a gear transmission mechanism.

5 Claims, 3 Drawing Sheets

(51) Int. Cl.

| | |
|---|---|
| ***B22D 11/115*** | (2006.01) |
| ***B22D 11/18*** | (2006.01) |
| ***B22D 11/049*** | (2006.01) |

EQUIPMENT AND METHOD OF SEMI-CONTINUOUS CASTING OPTIMIZED BY SYNERGISTIC ACTION OF TRAVELING MAGNETIC FIELD AND ULTRASOUND WAVE FOR THIN-WALLED ALLOY CASTING WITH EQUAL OUTER DIAMETER

BACKGROUND OF THE PRESENT INVENTION

Field of Invention

The present invention relates to semi-continuous casting equipment, and more particularly to near-net-shape semi-continuous casting equipment and semi-continuous casting method which utilizes synergistic action of traveling magnetic field and ultrasound wave to carry out real-time optimization of the mushy zone of the alloy melt in the semi-continuous casting process.

Description of Related Arts

At present, a variety of alloy material castings such as ZL205A aluminum alloy and other Al—Cu based alloys are in large demand in the different fields such as aviation and aerospace. However, many thin-walled alloy castings with equal outer diameter has a relatively large size, a relatively thin wall, and a relatively large solidification intervals of alloy materials, there are many problems such as structural defects, cumbersome process and high cost in the casting process, which greatly increases the difficulty of casting and reduces production efficiency.

At present, the traditional preparation process of large-scale thin-walled alloy castings with equal outer diameter is usually differential pressure casting or anti-gravity casting, which has an excessively high cost of manufacture; and the continuous casting process of thin-walled castings usually needs to be combined with subsequent processing, which is relatively cumbersome. There is almost no semi-continuous casting equipment for thin-walled alloy castings with equal outer diameter. In practical applications, it is difficult to achieve real-time and effective melt processing. Because cylindrical thin-walled alloy castings generally have a relatively small wall thickness, it is more difficult to optimize and improve the alloy melt and microstructure in the semi-continuous casting process. Moreover, the traditional semi-continuous casting equipment cannot achieve effective near-net forming, and it is necessary to perform secondary processing and other subsequent treatments on the castings after semi-continuous casting, which greatly increases production costs and wastes resources. Therefore, traditional semi-continuous casting equipment has serious drawbacks and cannot be widely used in high-precision and new technology fields such as aviation, aerospace, and etc. Accordingly, new ideas should be put forward for the improvement.

At present, the ultrasonic treatment is used to purify and degas the alloy melt, but effect is very limiting. The existing ultrasonic treatment can only promote the nucleation of impurities and gases. However, it is ineffective to separate the impurities and gases from the alloy melt because the viscosity of the alloy melt is relatively high. In other words, the separation effect between impurities, gas and alloy melt is not very obvious.

At present, the conventional magnetic fields treatment casting equipment can exert a better effect in the purification and feeding of alloys. However, it does not have a great influence on the nucleation of the alloy microstructure, and it has limitations in improving the alloy microstructure. Also, the conventional magnetic field treatment equipment cannot achieve continuous and uniform treatment of the alloy, which prone to problems such as segregation and uneven microstructure inside the alloy castings.

In summary, for the mass and automated production of thin-walled alloy castings with equal outer diameters, the real-time optimization of the semi-continuous casting process of alloy melts, and the effective improvement of alloy structure and the effective performance improvement, it is necessary to propose a brand new semi-continuous casting equipment to meet all the needs at the same time, so that near net forming of thin-walled alloy castings with equal outer diameter can be realized, the production efficiency can be increased, and the production costs can be reduced.

SUMMARY OF THE PRESENT INVENTION

An object of the present invention is to provide a semi-continuous casting equipment and a semi-continuous casting method that is optimized by synergistic action of traveling magnetic field and ultrasonic wave for thin-walled alloy casting with equal outer diameter, thereby real-time purification treatment of alloy melt, effective improvement of alloy microstructure, effective improvement of performance, elimination or reduction of subsequent treatment processes, and effective cost reduction can be achieved.

Another object of the preset invention is to provide a semi-continuous casting equipment and a semi-continuous casting method that is optimized by synergistic action of traveling magnetic field and ultrasonic wave for thin-walled alloy casting with equal outer diameter to effectively separate impurities and gases from the alloy melt with high viscosity for purification and degasification.

According to the present invention, a semi-continuous casting equipment for thin-walled alloy casting with equal outer diameter which is optimized by synergistic action of traveling magnetic field and ultrasonic wave comprises: a melting and insulation device, a traveling magnetic field generator, a ultrasonic wave generator, a motion system, an ultrasonic limit baffle, a position control unit, a mold core and an outer mold, wherein on the working platform, the melting and insulation device, a heat insulation panel, the traveling magnetic field generator and a water-cooled crystallizer are sequentially stacked from top to bottom, the outer mold is sleeved at an inner portion of the traveling magnetic field generator and is positioned on the water-cooled crystallizer, and the mold core is provided inside the outer mold and is positioned on the bottom plate.

The position control unit has a T-shaped structure formed by a horizontal member and a vertical member below the horizontal member. Two position control units are arranged on the left and right sides and on top of the working platform respectively. The ultrasonic limit baffle is overlapped and positioned on the horizontal member of the position control unit. The ultrasonic wave generator is affixed on the ultrasonic limit baffle.

The motion system comprises a screw nut, a screw guiding rail, a moving push plate, a push rod and a support rod. Two screw guiding rails are vertically arranged on a lower surface of the working platform and extended downwardly. One screw nut is sleeved on one screw guiding rail to form a screw pair. The moving push plate is fixedly connected to the screw nut. The two screw guiding rails are driven by the motor and the gear to rotate synchronously to drive the moving push plate on the screw guiding rails to move up and down. Two support rods and two push rods are vertically arranged on the moving push plate and extended upwardly, and the tops of the two support rods are connected to a bottom plate. The push rod penetrates through the working platform and the position control unit, and the ultrasonic limit baffle is pushed to move upward when the push rod is moving upward (upstroke). The ultrasonic wave generator on the ultrasonic limit baffle extends downward into a casting cavity between the mold core and the outer mold.

According to the present invention, a semi-continuous casting method that is optimized by synergistic action of traveling magnetic field and ultrasonic wave for thin-walled alloy castings with equal outer diameter and large solidification intervals is implemented according to the following steps:

1. Arranging a melting and insulation device, a heat insulation panel, a traveling magnetic field generator and a water-cooled crystallizer sequentially from top to bottom on a working platform, sleeving an outer mold at an inner portion of the traveling magnetic field generator which is positioned on the water-cooled crystallizer, providing a mold core inside the outer mold at a position on the bottom plate and defining a casting cavity between the mold core and the outer mold, and arranging an ultrasonic wave generator extending into the casting cavity.

2. At an initial state, aligning the bottom plate with a bottom surface of an inner cavity of the melting and insulation device fittingly, turning on the ultrasonic wave generator, putting the alloy material with large solidification intervals inside the melting and insulation device for melting, performing heat preservation at a temperature 50~60° C. higher than the melting point of the alloy material, carrying out ultrasonic treatment on the molten alloy through the ultrasonic wave generator in the process of heat preservation, then obtaining the insulated and ultrasonic treated smelting alloy.

3. Then pulling downwards the mold core and the ultrasonic wave generator vertically and synchronously, and turning on the traveling magnetic field generator and the water-cooled crystallizer when the pulling process begins.

4. Limiting and fixing a position of the ultrasonic wave generator when the ultrasonic wave generator is pulled to the position of the mushy zone of the alloy so as to ensure that the mushy zone can be simultaneously subjected to magnetic fields treatment of the traveling magnetic field generator and an ultrasonic treatment of the ultrasonic wave generator, continuing the pulling of the mold core until the end of the casting process, thereby a semi-continuous casting for thin-walled alloy castings with equal outer diameter and large solidification intervals is completed.

The semi-continuous casting equipment that is optimized by synergistic action of traveling magnetic field and ultrasonic wave for thin-walled alloy casting with equal outer diameter of the present invention mainly comprises the following components: a melting and insulation system, a traveling magnetic field generating system, an ultrasonic wave generating system, a motion system, a water-cooled crystallization system, a position control system, and a shaping forming system.

The ultrasonic wave generating system is mainly composed of an ultrasonic wave generator and related circuits. The ultrasonic wave generator can control the ultrasonic power emitted from 1 W to 2000 W.

The position control system comprises an ultrasonic limit baffle and a position control platform. The ultrasonic wave generator is affixed on the ultrasonic limit baffle. When the ultrasonic limit baffle falls on the limit platform during continuous casting, the ultrasonic generator is fixed at this position and no longer moves, thereby ensuring that the ultrasonic generator can act on the mushy zone of the alloy melt.

The shape forming system mainly comprises: a mold core and outer mold, thereby ensuring the formation of the thin-walled alloy castings with equal outer diameter.

The motion system mainly comprises: a motor, a screw guiding rail, a moving push plate, a push rod and a support rod. During the continuous casting process, the moving push plate is mainly controlled by the motor to move up and down on the screw guiding rail. The push rod is connected with the ultrasonic limit baffle to drive the ultrasonic wave generator to move up and down. The push rod and the ultrasonic limit baffle adopt a movable connection. When moving upward, the push rod will lift the ultrasonic limit baffle up and move upward. When moving downward to reach the position control unit, the push rod and the ultrasonic limit baffle will automatically disengage, and the push rod will continue to move downward with the moving push plate. The support rod is connected with the mold core to perform the upward and downward pulling movement of the continuous casting process.

According to the present invention, the melting and insulation system, the motion system and the water-cooled crystallization system ensure that the alloy mushy zone is in the action area of the traveling magnetic field generating system. The ultrasonic wave generating system, the position control system and the motion system ensure that the ultrasonic treatment acts on the alloy mushy zone. The shaping forming system ensures the formation of alloy. The mutual cooperation of the various systems of the present invention realizes real-time refining, degassing and structural control of the alloy melt, and solves the problems that can't be solved by either a single magnetic field or an ultrasonic field. In other words, the present invention can efficiently improve the quality of the solidified microstructure further to obtain the nearly net forming effect of the alloy semi-continuous casting process.

This summary presented above is provided merely to introduce certain concepts and not to identify any key or essential features of the claimed subject matter.

DETAILED DESCRIPTION OF THE PREFERRED EMBODIMENT

Figure 1:
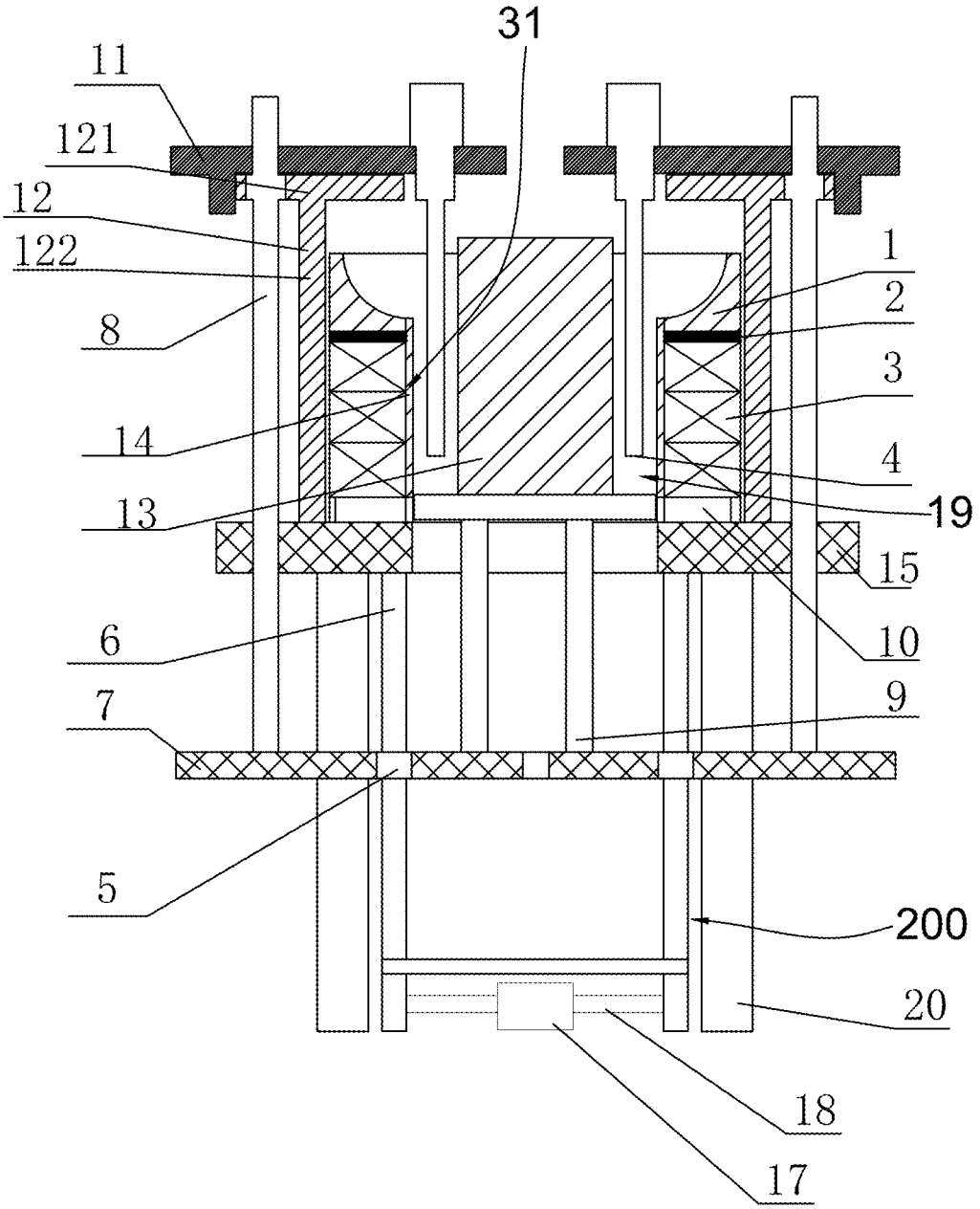
FIG. 1 is a schematic diagram the semi-continuous casting equipment optimized by traveling magnetic field and ultrasonic wave for thin-walled alloy casting with equal outer diameter at a stable state of time according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Embodiment 1

According to this embodiment, a semi-continuous casting equipment that is optimized by synergistic action of traveling magnetic field and ultrasonic wave for thin-walled alloy casting with equal outer diameter comprises: a melting and insulation device 1 for melting and keeping the temperature, a traveling magnetic field generator 3, a ultrasonic wave generator 4, a motion system 200, an ultrasonic limit baffle 11, a position control unit 12, a mold core 13 and an outer mold 14. On the working platform 15, the melting and insulation device 1, a heat insulation panel 2, the traveling magnetic field generator 3 and a water-cooled crystallizer 10 are sequentially stacked from top to bottom. The outer mold 14 is sleeved at an inner portion 31 of the traveling magnetic field generator 3 and is positioned on the water-cooled crystallizer 10. The mold core 13 is provided inside the outer mold 14 and is positioned on the bottom plate 16.

The position control unit 12 has a T-shaped structure formed by a horizontal member 121 and a vertical member 122. Two position control units 12 are arranged on the left and right sides and on top of the working platform 15 respectively. The ultrasonic limit baffle 11 is overlapped and positioned on the horizontal member 121 of the position control unit 12. The ultrasonic wave generator 4 is affixed on the ultrasonic limit baffle 11. The position control unit 12 control the lowest position of the ultrasonic baffle 11 along a vertical direction. When the ultrasonic baffle 11 is guided to move vertically downward, the position control unit 12 can stop the ultrasonic baffle 11 from further movement when reaching the position control unit 12.

The motion system 200 comprises a screw nut 5, a screw guiding rail 6, a moving push plate 7, a push rod 8 and a support rod 9. Two screw guiding rails 6 are vertically arranged on a lower surface of the working platform 15 and extended downwardly. One screw nut 5 is sleeved on one screw guiding rail 6 to form a screw pair. The moving push plate 7 is fixedly connected with the screw nut 5. The two screw guiding rails 6 are driven by a gear 18 and the motor 17 to rotate synchronously to drive the moving push plate 7 on the screw guiding rails 6 to move up and down. Two support rods 9 and two push rods 8 are vertically arranged on the moving push plate 7 and extended upwardly, and the tops of the two support rods 9 are connected with a bottom plate 16. The push rod 8 penetrates through the working platform 15 and the position control unit 12, and the ultrasonic limit baffle 11 is pushed to move upward when the push rod 8 is moving upward. The ultrasonic wave generator 4 on the ultrasonic limit baffle 11 extends downward into a casting cavity 19 between the mold core 13 and the outer mold 14.

According to the semi-continuous casting equipment that is optimized by synergistic action of traveling magnetic field and ultrasonic wave for thin-walled alloy castings with equal outer diameter of this embodiment of the present invention, the ultrasonic wave generator and the mold core are synchronized

Embodiment 2

The difference between this embodiment and the embodiment 1 is that a height of the screw guiding rail 6 is greater than twice a total stroke of the continuous casting.

In this embodiment, the height of the screw guiding rail 6 and the working platform 15 are the same, and the two guiding rails 6 are parallel to each other and perpendicular to the ground.

Embodiment 3

The difference between this embodiment and the embodiment 1 or embodiment 2 is that the water-cooled crystallizer 10 adopts a hollow copper plate structure, and circulating water is introduced into the water-cooled crystallizer 10 for forced cooling.

This embodiment ensures that the ultrasonic generator 4 can effectively act on the mushy zone during the alloy solidification process.

Embodiment 4

The difference between this embodiment and one of the embodiments 1-3 is that the material of the heat insulation board 2 is mica plate or high temperature asbestos.

Embodiment 5

The difference between this embodiment and one of the embodiments 1-4 is that a rotation of a gear 18 is driven by a motor 17 so that the screw guiding rails 6 is controlled to rotate synchronously through a gear transmission.

Embodiment 6

According to this embodiment, a semi-continuous casting method that is optimized by synergistic action of traveling magnetic field and ultrasonic wave for thin-walled alloy castings with equal outer diameter and large solidification intervals is implemented according to the following steps:

1. Arranging a melting and insulation device 1, a heat insulation panel 2, a traveling magnetic field generator 3 and a water-cooled crystallizer 10 sequentially from top to bottom on a working platform 15, sleeving an outer mold 14 at an inner portion 31 of the traveling magnetic field generator 3 which is positioned on the water-cooled crystallizer 10, providing a mold core 13 inside the outer mold 14 at a position on the bottom plate 16, defining a casting cavity 19 between the mold core 13 and the outer mold 14 and arranging an ultrasonic wave generator 4 extending into the casting cavity 19.

2. At an initial state, fittingly aligning the bottom plate 16 with a bottom surface of an inner cavity of the melting and insulation device 1, turning on the ultrasonic wave generator 4, putting the alloy material with large solidification intervals inside the melting and insulation device 1 for melting, performing heat preservation at a temperature 50~60° C. higher than the melting point of the alloy material, carrying out ultrasonic treatment on the molten alloy through the ultrasonic wave generator 4 in the process of heat preservation, then obtaining the insulated and ultrasonic treated smelting alloy.

3. Then pulling downwards the mold core 13 and the ultrasonic wave generator 4 vertically and synchronously, and turning on the traveling magnetic field generator 3 and the water-cooled crystallizer 10 when the pulling process begins.

4. Limiting and fixing a position of the ultrasonic wave generator 4 when the ultrasonic wave generator 4 is pulled to the position of the mushy zone of the alloy so as to ensure that the mushy zone can be simultaneously subjected to magnetic fields treatment of the traveling magnetic field generator 3 and an ultrasonic treatments of the ultrasonic generator 4, continue pulling of the mold core 13 until the end of the casting process, thereby a semi-continuous casting for thin-walled alloy castings with equal outer diameter and large solidification intervals is completed.

Embodiment 7

The difference between this embodiment and the embodiment 6 is that a traveling magnetic field strength of the traveling magnetic field generator 3 is controlled to approximately 0.001 T to 2 T.

In this embodiment, an axial direction of the traveling magnetic field is adjusted to be upward or downward.

Embodiment 8

The difference between this embodiment and the embodiment 6 or embodiment 7 is that a power of the ultrasonic generator 4 is controlled to approximately 1 W to 2000 W.

Embodiment 9

The difference between this embodiment and one of the embodiments 6-8 is that the lowering speed of the mold core 13 driven by the bottom plate 16 is approximately 1 μs to 500 μm/s.

Embodiment 10

The difference between this embodiment and one of the embodiments 6-9 is that in the step 2, the alloy material with large solidification intervals is Zn—Al alloy, Al—Cu alloy or Al—Pb alloy. Zn—Al alloy refers to alloys whose main constituents are zine and aluminum, Al—Cu alloy refers to alloys whose main constituents are aluminum and copper, and Al—Pb alloy refers to alloys whose main constituents are aluminum and lead.

Embodiment 11

The difference between this embodiment and one of the embodiments 6-10 is that in the step 2, the alloy material with large solidification intervals is magnesium alloy MA2-1, uranium-niobium alloy U2Nb or aluminum alloy ZL205A.

Embodiment 12

The difference between this embodiment and one of the embodiments 6-11 is that in the step 2, process heat preservation at the temperature 50~60° C. higher than the melting point of the alloy material for approximately 10 minutes to 20 minutes.

Embodiment 13

The difference between this embodiment and one of the embodiments 6-12 is that in the step 4, limiting and fixing a position of the ultrasonic wave generator 4 at a position corresponding to ⅔ inside the traveling magnetic field generator 3.

The position of the alloy mushy zone in this embodiment can be determined through experiments. The position of the mushy zone of the alloy material with large solidification intervals is (mostly) within the range of ⅔ after entering inside the traveling magnetic field generator 3.

Preferred Embodiment

According to this embodiment, a semi-continuous casting equipment that is optimized by synergistic action of traveling magnetic field and ultrasonic wave for thin-walled alloy castings with equal outer diameter comprises: a melting and insulation device 1 for melting and keeping the temperature, a traveling magnetic field generator 3, a ultrasonic wave generator 4, a motion system 200, an ultrasonic limit baffle 11, a position control unit 12, a mold core 13 and an outer mold 14. On the working platform 15, the melting and insulation device 1, a heat insulation panel 2, the traveling magnetic field generator 3 and a water-cooled crystallizer 10 are sequentially stacked from top to bottom. The working platform 15 is supported by two supporting legs 20. The outer mold 14 is sleeved at an inner portion 31 of the traveling magnetic field generator 3 and is positioned on the water-cooled crystallizer 10. The mold core 13 is provided inside the outer mold 14. The mold core 13 is positioned on the bottom plate 16.

The position control unit 12 has a T-shaped structure formed by a horizontal member 121 and a vertical member 122. Two position control units 12 are arranged on the left and right sides and on top of the working platform 15 respectively. The ultrasonic limit baffle 11 is overlapped and positioned on the horizontal member 121 of the position control unit 12. The ultrasonic wave generator 4 is affixed on the ultrasonic limit baffle 11.

The motion system 200 comprises a screw nut 5, a screw guiding rail 6, a moving push plate 7, a push rod 8 and a support rod 9. Two screw guiding rails 6 are vertically arranged on a lower surface of the working platform 15 and extended downwardly. One screw nut 5 is sleeved on one screw guiding rail 6 to form a screw pair. The moving push plate 7 is fixedly connected with the screw nut 5. The two screw guiding rails 6 are driven by the motor 17 and a gear 18 to rotate synchronously to drive the moving push plate 7 on the screw guiding rails 6 to move up and down. Two support rods 9 and two push rods 8 are vertically arranged on the moving push plate 7 and extended upwardly, and the tops of the two support rods 9 are connected with a bottom plate 16. The mold core 13 on the bottom plate 16 is driven by the moving push plate 7 to have a downward pulling movement inside the outer mold 14. The push rod 8 penetrates through the working platform 15 and the position control unit 12, and the ultrasonic limit baffle 11 is pushed to move upward by a top portion of the push rod 8 during upstroke movement. The ultrasonic wave generator 4 on the ultrasonic limit baffle 11 extends into a casting cavity 19 between the mold core 13 and the outer mold 14.

APPLICATION EXAMPLES

According to this embodiment, a semi-continuous casting method that is optimized by synergistic action of traveling magnetic field and ultrasonic wave for thin-walled alloy castings with equal outer diameter and large solidification intervals is implemented according to the following steps:

1. Arranging a melting and insulation device 1, a heat insulation panel 2, a traveling magnetic field generator 3 and a water-cooled crystallizer 10 sequentially from top to bottom on a working platform 15, sleeving an outer mold 14 at an inner portion 31 of the traveling magnetic field generator 3 which is positioned on the water-cooled crystallizer 10, providing a mold core 13 inside the outer mold 14 at a position on the bottom plate 16, defining a casting cavity 19 between the mold core 13 and the outer mold 14 and arranging an ultrasonic wave generator 4 extending into the casting cavity 19. The bottom of the casting cavity 19 is the bottom plate 16.

2. At an initial state, fittingly aligning the bottom plate 16 with a bottom surface of an inner cavity of the melting and insulation device 1, turning on the ultrasonic wave generator 4, putting Al-5Cu alloy material inside the melting and insulation device 1 for melting, performing heat preservation at a temperature 50° C. higher than the melting point of the alloy material for 15 minutes, carrying out ultrasonic treatment on the molten alloy through the ultrasonic wave generator 4 at a power of 1600 W in the process of heat preservation, then obtaining the insulated and ultrasonic treated smelting alloy.

3. Then processing pulling by moving the mold core 13 and the ultrasonic wave generator 4 vertically downwards synchronously and controlling a pulling speed at 150 μm/s turning on the traveling magnetic field generator 3 and the water-cooled crystallizer 10 when the pulling process begins, controlling a magnetic field strength to 1.2 T for continuous casting of the insulated and ultrasonic treated smelting alloy.

4. Limiting and fixing a position of the ultrasonic wave generator 4 when the ultrasonic wave generator 4 is pulled to the position of the mushy zone of the alloy (that is when moving downward along a vertical direction to the inside of the traveling magnetic field generator 3, a position corresponding to ⅔ of a height the traveling magnetic field generator 3 from the top of the traveling magnetic field generator 3) so as to ensure that the mushy zone is simultaneously subjected to magnetic fields treatment of the traveling magnetic field generator 3 and an ultrasonic treatment of the ultrasonic generator 4, continuing pulling of the mold core 13 until the end of the casting process, thereby a semi-continuous casting for thin-walled alloy castings with equal outer diameter and large solidification intervals is completed.

Figure 2:
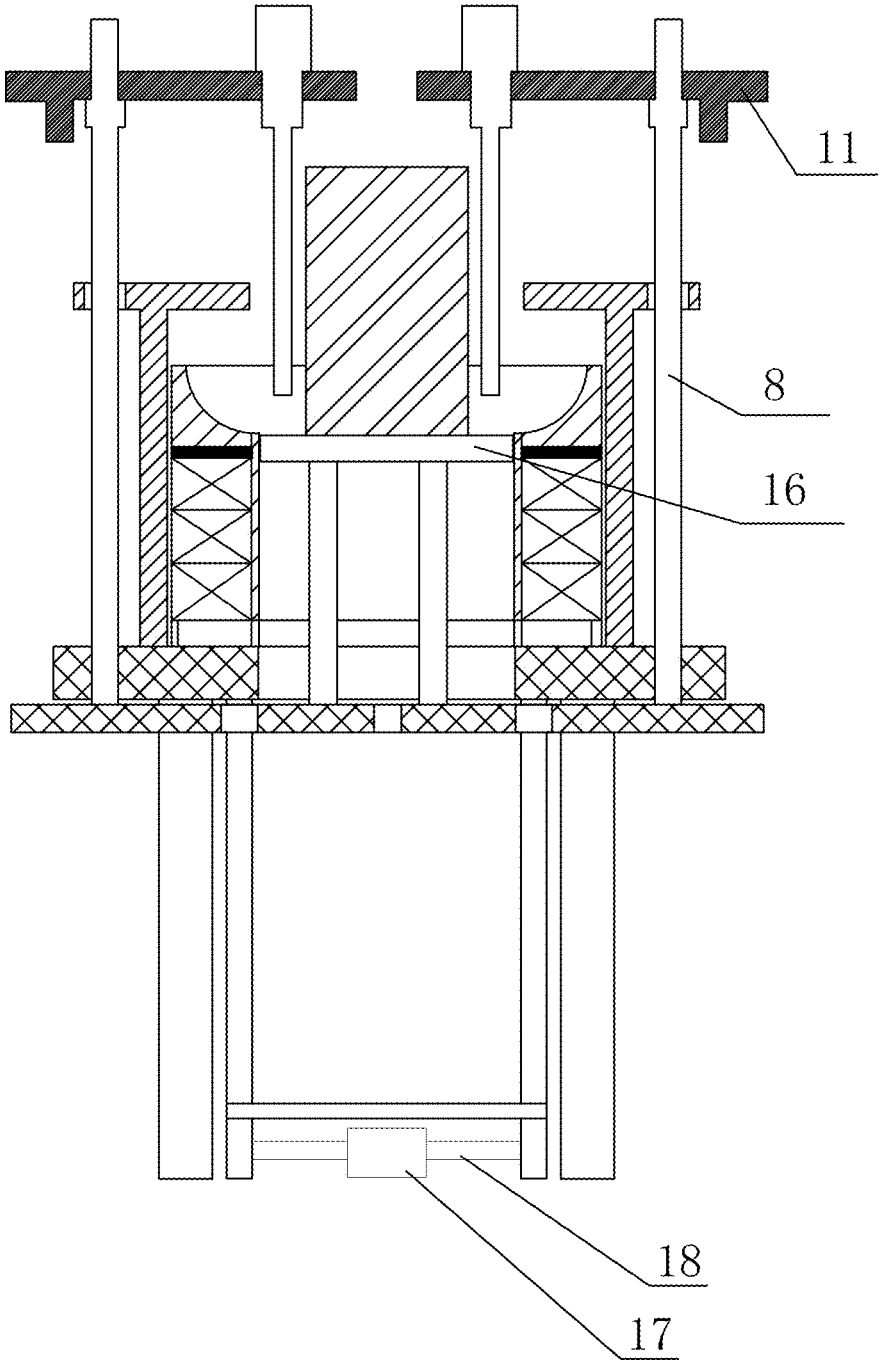
FIG. 2 is a schematic diagram of the semi-continuous casting equipment optimized by traveling magnetic field and ultrasonic wave for thin-walled alloy casting with equal outer diameter at an initial state of time according to the above preferred embodiment of the present invention.

Referring to FIG. 1 and FIG. 2 of the drawings, the semi-continuous casting equipment that is optimized by synergistic action of traveling magnetic field and ultrasonic wave for thin-walled alloy castings with equal outer diameter comprises: a melting and insulation device 1, a heat insulation panel 2, a traveling magnetic field generator 3, and a water-cooled crystallizer 10 sequentially positioned at a top-down direction on the working platform 15. A height of the screw guiding rail 6 is the same as a height of the working platform 15 and is greater than twice a total stroke of the continuous casting. The screw guiding rail 6 consists of two rail members parallel to each other and perpendicular to the ground. The motor 17 controls the moving push plate 7 to move. The moving push plate 7 is assembled with the screw guiding rail 6 and moves up and down along the screw guiding rail 6. The support rod 9 and the push rod 8 are fixedly connected on the moving push plate 7. The mold core 13 is fixedly mounted on the support rods 9. The ultrasonic limit baffle 11 and the push rods 8 is moveably engaged with each other. The push rod 8 acts as a support for the ultrasonic limit baffle 11 is capable of lifting up the ultrasonic limit baffle 11. When the push rod 8 is moving upwards, the ultrasonic limit baffle 11 is lifted upwardly to move at an upward direction. When the push rod 8 is moving upwards, the ultrasonic limit baffle 11 is supported by the push rod 8 to move at a downward direction until reaching the position control unit 12, then the ultrasonic limit baffle 11 and the push rods 8 are separated, the ultrasonic limit baffle 11 and the ultrasonic wave generator 4 are positioned on the position control unit 12. The position control unit 12 can be adjusted in height according to the actual distance requirements. The outer diameter of the outer mold 14 is the same as the inner diameter of the traveling magnetic field generator 3, and the inner diameter of the outer mold 14 is the same as the inner diameter of the water-cooled crystallizer 10. The outer mold 14 is positioned on top of the water-cooled crystallizer 10 and is fittingly and tightly placed face-to-face to each other. The water-cooled crystallizer 10 adopts a water-cooled hollow copper plate structure, and circulating water is introduced into the water-cooled crystallizer 10 for forced cooling.

Preferably, as shown in FIGS. 1 and 2 of the drawings, the mold core 13 has a cylindrical structure defining an outer surface. The outer mold 14 has a hollow cylindrical structure defining an outer side and an inner side and is co-axially aligned with the mold core 13. The traveling magnetic field generator 3 surrounds the outer side of the outer mold 14 from the bottommost of the outer side of the outer mold 14 to extend upwardly and has a height shorter than a height of the outer mold 14. The bottom plate 16 is a circular plate coaxially arranged below the mold core 13 and has a diameter slightly smaller than a diameter of the inner side of the outer mold 14 to fit inside the outer mold 14 capable of sliding along the outer mold 14 in the vertical direction. The outer mold 14 and the traveling magnetic field generator 3 are fittingly positioned on top of the water-cooled crystallizer 10 such that a top of the water-cooled crystallizer 10 is fully overlapped by the outer mold 14 and the traveling magnetic field generator 3. At an initial state of the casting process, the mold core 13 and the ultrasonic wave generator 4 are both at a higher level than the outer mold 14 and are guided to move downward in the vertical direction. At the stable state of the casting process, the ultrasonic wave generator 4 extends along a vertical direction along the traveling magnetic field generator 3 from the top to ⅔ of the height of the traveling magnetic field generator 3 so as to ensure that the mushy zone of the alloy melt is simultaneously subjected to magnetic field treatment of the traveling magnetic field generator 3 and an ultrasonic treatment of the ultrasonic generator 4 while the mold core 13 reaches the same level as the outer mold 14. The semi-continuous casting equipment that is optimized by synergistic action of traveling magnetic field and ultrasonic wave for thin-walled alloy castings with equal outer diameter according to this embodiment of the present invention has the following advantageous effect:

The ultrasonic treatment in this embodiment can effectively promote the nucleation of gas and impurities in the cylindrical thin-walled alloy melt, effectively purify the alloy melt, avoid the subsequent secondary treatment process, save costs, and reduce resource consumption.

The traveling magnetic field in this embodiment can effectively feed the cylindrical thin-walled alloy solidification process, and promote the separation of impurities and gases in the melt, eliminate segregation, obtain the overall uniform structure of the cylindrical thin-walled alloy casting, and improve the mechanical properties.

Through this embodiment, the synergistic effect of traveling magnetic field and ultrasound wave is realized, which promotes the effective nucleation and separation of gas and impurities in the cylindrical thin-walled alloy melt, improves the alloy structure, promotes the formation of equiaxed grains, and improves the mechanical properties.

Figure 3:
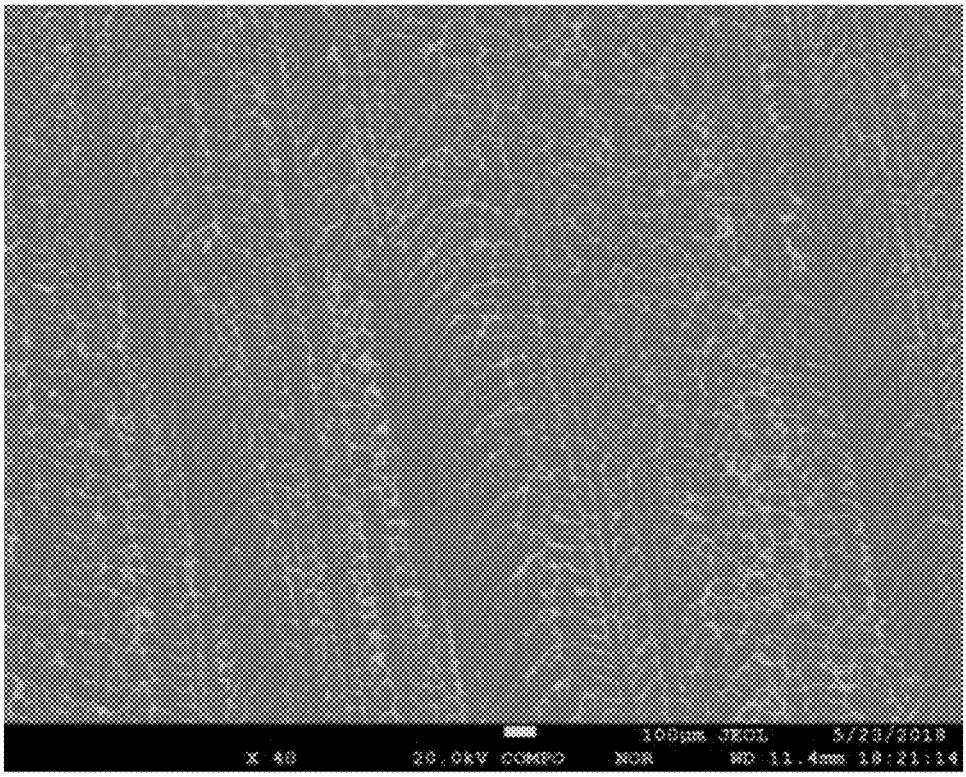
FIG. 3 is a scanning electron micrograph of the casting structure prepared by the semi-continuous casting equipment optimized by traveling magnetic field and ultrasonic wave for thin-walled alloy casting with equal outer diameter according to the above preferred embodiment of the present invention.
Figure 4:
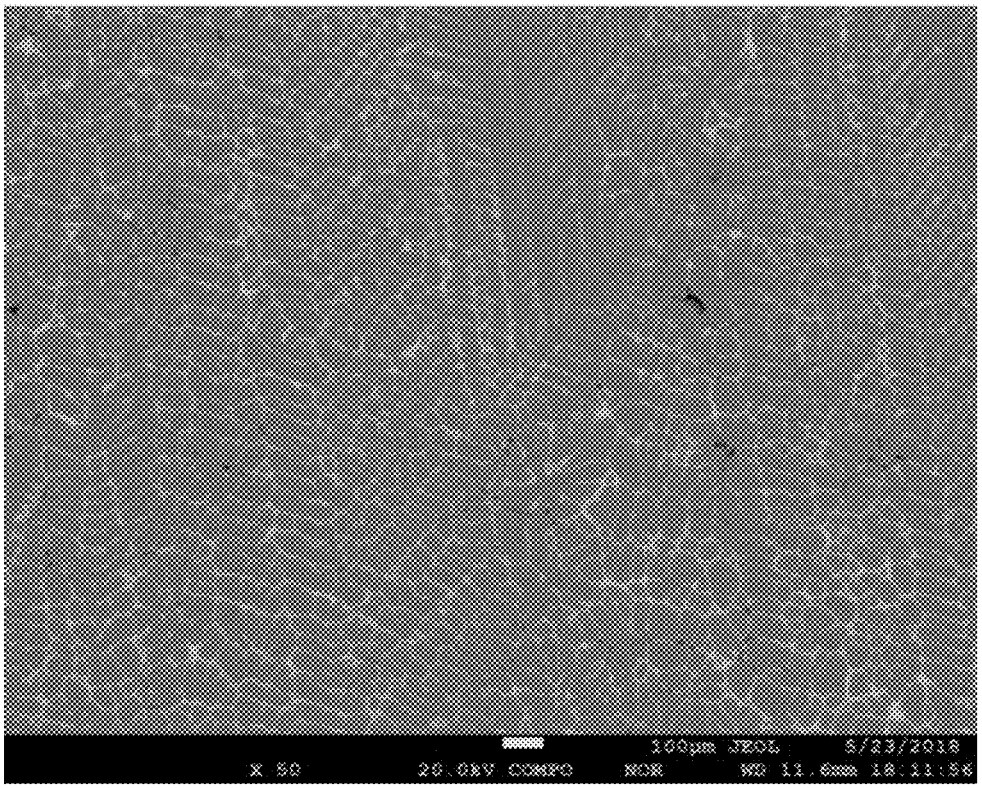
FIG. 4 is a scanning electron micrograph of the casting structure prepared by the semi-continuous casting equipment without applying a traveling magnetic field and ultrasonic wave.

According to this embodiment, the traveling magnetic field and ultrasonic wave are applied together for providing synergistic action. FIG. 3 is a scanning electron microscope image of the Al-5Cu alloy casting structure prepared by this equipment, and FIG. 4 is a scanning electron microscope image of the casting structure prepared without applying traveling magnetic fields. It can be seen that this embodiment promotes the effective nucleation and separation of gases and impurities in the cylindrical thin-walled alloy melt, improves the alloy structure, and improves the mechanical properties. At the same time, it can improve the defects such as segregation, shrinkage porosity and shrinkage of the cylindrical thin-walled alloy, thereby promoting the overall uniformity of the castings, eliminating the cost and waste of secondary treatment after semi-continuous casting, and achieving the near-net shape process of real-time optimization of the melt in the semi-continuous casting process.

The present invention, while illustrated and described in terms of a preferred embodiment and several alternatives, is not limited to the particular description contained in this specification. Additional alternative or equivalent components could also be used to practice the present invention.

What is claimed is:

1. A semi-continuous casting equipment for thin-walled alloy castings with equal outer diameter that is optimized by synergistic action of traveling magnetic field and ultrasonic wave, comprising:

a melting and insulation device, a traveling magnetic field generator, an ultrasonic wave generator, a motion system, an ultrasonic limit baffle, two position control units, a mold core, an outer mold, a bottom plate, a working platform, a heat insulation panel, a water-cooled crystallizer, and a motor, wherein said melting and insulation device, said heat insulation panel, said traveling magnetic field generator and said water-cooled crystallizer are sequentially stacked from top to bottom on said working platform, said outer mold is sleeved at an inner portion of said traveling magnetic field generator and is positioned on said water-cooled crystallizer, and said mold core is provided inside said outer mold and is positioned on said bottom plate to define a casting cavity between said mold core and said outer mold, wherein each said position control unit has a T-shaped structure formed by a horizontal member and a vertical member below said horizontal member, said two position control units are arranged on top of said working platform at two opposite sides of said working platform respectively, said ultrasonic limit baffle is overlappingly connected on said horizontal member of said position control unit, and said ultrasonic wave generator is fixedly mounted on said ultrasonic limit baffle and extends downward into said casting cavity, said motion system comprises two screw nuts, two screw guiding rails, two push rods and two support rods at said two opposite sides of said working platform and a moving push plate, wherein said two screw guiding rails are connected to a lower surface of said working platform and extended vertically and downwardly, said two screw nuts are sleeved on said two screw guiding rails respectively to form two screw pairs, said moving push plate is fixedly connected to said two screw nuts to moveably connected to said two screw guiding rails, said two screw guiding rails are driven by synchronous rotational movement of said motor so that said moving push plate is driven to have an up and down movement through said two guiding rails, said two support rods and said two push rods are connected to said moving push plate and vertically extended, each said support rod is connected to said bottom plate at a top end of said support rod, each said push rod penetrates through said working platform and said position control unit, said ultrasonic limit baffle is pushed to move upward by said push rod when said push rod is driven to move upward.

2. The semi-continuous casting equipment for thin-walled alloy castings with equal outer diameter that is optimized by synergistic action of traveling magnetic field and ultrasonic wave according to claim 1, wherein a height of said screw guiding rail is greater than two times of a total stroke of continuous casting.

3. The semi-continuous casting equipment for thin-walled alloy castings with equal outer diameter that is optimized by synergistic action of traveling magnetic field and ultrasonic wave according to claim 1, wherein said water-cooled crystallizer has a hollow copper plate structure in such a manner that circulating water is introduced into said water-cooled crystallizer for forced cooling.

4. The semi-continuous casting equipment for thin-walled alloy castings with equal outer diameter that is optimized by synergistic action of traveling magnetic field and ultrasonic wave according to claim 1, wherein said heat insulation board is made of mica plate or high temperature asbestos.

5. The semi-continuous casting equipment for thin-walled alloy castings with equal outer diameter that is optimized by synergistic action of traveling magnetic field and ultrasonic wave according to claim 1, wherein a rotation movement is driven by said motor so that said screw guiding rails are controlled to rotate synchronously through a gear transmission.

* * * * *